US011046555B2

(12) United States Patent
Gainche et al.

(10) Patent No.: US 11,046,555 B2
(45) Date of Patent: Jun. 29, 2021

(54) FRAME FOR AN ELEVATOR SYSTEM

(71) Applicant: TK Elevator Innovation and Operations GmbH, Essen (DE)

(72) Inventors: Philippe Gainche, Großbettlingen (DE); Michael Kirsch, Kirchheim unter Teck (DE); Christoph Pawelski, Dresden (DE); Christoph Klotzbach, Dresden (DE)

(73) Assignee: TK Elevator Innovation and Operations GmbH, Duesseldorf (DE)

( * ) Notice: Subject to any disclaimer, the term of this patent is extended or adjusted under 35 U.S.C. 154(b) by 499 days.

(21) Appl. No.: 15/772,680

(22) PCT Filed: Oct. 25, 2016

(86) PCT No.: PCT/EP2016/075599
§ 371 (c)(1),
(2) Date: May 1, 2018

(87) PCT Pub. No.: WO2017/076685
PCT Pub. Date: May 11, 2017

(65) Prior Publication Data

US 2018/0273348 A1 Sep. 27, 2018

(30) Foreign Application Priority Data

Nov. 4, 2015 (DE) ..... 10 2015 221 653.5

(51) Int. Cl.
*B66B 11/02* (2006.01)
*B66B 11/04* (2006.01)

(52) U.S. Cl.
CPC ..... *B66B 11/0206* (2013.01); *B66B 11/0407* (2013.01)

(58) Field of Classification Search
CPC . B66B 11/0206; B66B 11/0407; B66B 9/003; B66B 9/006; B66B 11/022; B66B 11/0213
See application file for complete search history.

(56) References Cited

U.S. PATENT DOCUMENTS

2006/0163008 A1* 7/2006 Godwin ..... B66B 9/003 187/288
2017/0036889 A1* 2/2017 Ericson ..... B66B 7/025
2017/0225927 A1* 8/2017 Kirsch ..... B66B 9/00

FOREIGN PATENT DOCUMENTS

CN 201419958 Y 3/2010
CN 201553520 U 8/2010
(Continued)

OTHER PUBLICATIONS

English Translation of International Search Report issued in PCT/EP2016/075599, dated Feb. 1, 2017 (dated Feb. 20, 2017).

*Primary Examiner* — Diem M Tran
(74) *Attorney, Agent, or Firm* — William J. Cassin

(57) ABSTRACT

An elevator system may include a car that is movable in an elevator shaft. The car may include a frame and a cabin. The elevator system may also comprise a first linear motor with a first primary part and a first secondary part. The first primary part of the first linear motor may be arranged on a first rail that is disposed in the elevator shaft. The frame may also include a first drive beam on which the first secondary part is disposed. The frame may further include a first lower beam for supporting the cabin and a first connecting segment that connects the first lower beam to the first drive beam.

21 Claims, 2 Drawing Sheets

(56) References Cited

FOREIGN PATENT DOCUMENTS

| | | | | |
|---|---|---|---|---|
| CN | 103010904 | A | | 4/2013 |
| DE | 102014104458 | A | | 10/2015 |
| DE | 102014219862 | A | | 3/2016 |
| EP | 1507329 | A | | 2/2005 |
| EP | 1970341 | A | | 9/2008 |
| JP | 06080353 | A | * | 3/1994 |
| JP | H07232877 | A | | 9/1995 |
| JP | 09240960 | A | | 9/1997 |
| JP | 2902867 | B2 | | 6/1999 |
| WO | 2014182272 | A | | 11/2014 |
| WO | 2016050407 | A | | 4/2016 |

* cited by examiner

FRAME FOR AN ELEVATOR SYSTEM

CROSS REFERENCE TO RELATED APPLICATIONS

This application is a U.S. National Stage Entry of International Patent Application Serial Number PCT/EP2016/075599, filed Oct. 25, 2016, which claims priority to German Patent Application No. DE 10 2015 221 653.5, filed Nov. 4, 2015, the entire contents of both of which are incorporated herein by reference.

FIELD

The present disclosure generally relates to elevator systems, including frames for elevator systems having cars that are movable in elevator shafts.

BACKGROUND

Elevator systems serve for conveying passengers between different storeys of a building. To this end, a car is moved inside an elevator shaft between the storeys. To this end, the car is conventionally connected by a cable to a counterweight, wherein the cable runs via a drive plate which is driven. Alternative elevator systems, however, no longer use counterweights and are driven by linear motors which are integrated in the rails and cars. For example, such an elevator system which is provided with a linear motor is disclosed in EP 1507329. Since a counterweight is not used in these elevator systems, the weight of the car is not able to be compensated by the counterweight. As a result, it is advantageous to reduce the weight of the car as far as possible. However, the car has to be sufficiently stable in order to be able to take up drive forces and braking forces. Moreover, the use of linear motors results in the point of action of the drive forces not being located on the car ceiling, as in conventional cable-guided elevator systems, but in the lateral region of the car in which the linear drive extends. As a result, the known car constructions for cable-guided elevator systems are not able to be used here.

Thus a need exists for a car construction which that is adapted to the for use with of a linear drive.

DETAILED DESCRIPTION

Figure 1:
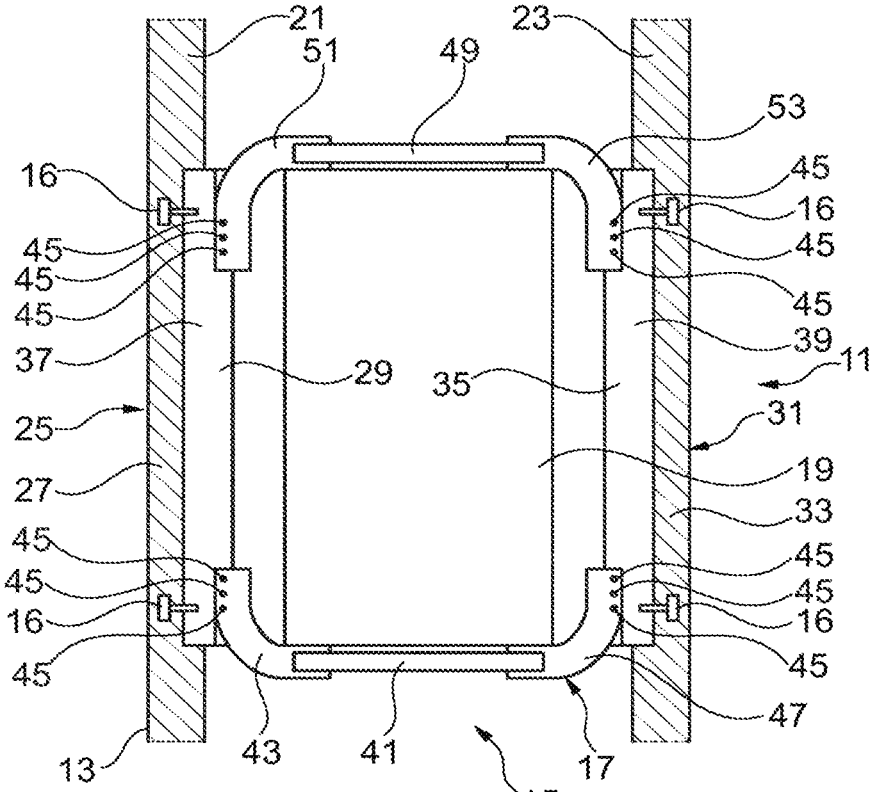
FIG. 1 is a side view of an example elevator system.

Although certain example methods and apparatus have been described herein, the scope of coverage of this patent is not limited thereto. On the contrary, this patent covers all methods, apparatus, and articles of manufacture fairly falling within the scope of the appended claims either literally or under the doctrine of equivalents. Moreover, those having ordinary skill in the art will understand that reciting 'a' element or 'an' element in the appended claims does not restrict those claims to articles, apparatuses, systems, methods, or the like having only one of that element, even where other elements in the same claim or different claims are preceded by 'at least one' or similar language. Similarly, it should be understood that the steps of any method claims need not necessarily be performed in the order in which they are recited, unless so required by the context of the claims. In addition, all references to one skilled in the art shall be understood to refer to one having ordinary skill in the art.

In some examples, an elevator system may comprise a car that which is movable in an elevator shaft. The car may comprise a frame and a cabin. The elevator system may comprise a first linear motor with a first primary part and a first secondary part. Moreover, a first rail may be arranged in the elevator shaft, with the first primary part of a first linear motor being arranged thereon. The frame may comprise a first drive beam, with the first secondary part being arranged thereon. The first secondary part of the first linear motor in some examples at least partially encloses the first primary part of the first linear motor. Moreover, the frame may comprise a first lower beam for supporting the cabin and the frame may comprise a first connecting segment that connects the first lower beam to the first drive beam.

This construction has the advantage that the drive forces are introduced in a uniformly distributed manner over the entire drive beam into the car and diverted to the cabin via the first connecting segment and the first lower beam. Moreover, this modular construction has the result that different cars may be produced from the same basic components. For example, the length of the lower beam may be cut to length according to the width of the desired cabin. The length of the drive beam, on the one hand, may be adapted to the desired cabin height and, on the other hand, it is also possible to use a longer drive beam in order to obtain a greater drive force when, for example, the car is to be designed for greater loads. In this case, if required, the drive beam would be longer than the cabin height.

The modular construction, therefore, permits a particularly efficient production process, since the same basic components may be used for different cars. The storage is thus significantly reduced. For example, only hollow profiles with a specific cross section have to be stored in order to provide lower beams and upper beams (see below) of different lengths for different cabin widths.

In a developed variant of the invention, a second rail is arranged in the elevator shaft. The elevator system then comprises a second linear motor with a second primary part and a second secondary part, wherein the second primary part of the second linear motor is arranged on the second rail. In this case, the frame comprises a second drive beam, the second secondary part being arranged thereon and a second connecting segment which connects the first lower beam to the second drive beam. This has the technical advantage that the car comprises only two drive beams, the drive force being transmitted thereby to the car. Thus the acting forces may be designed, in particular, to be symmetrical so that the acting torques are reduced and/or in particular mutually cancel one another out.

For simplifying the storage during the production of the cars according to the invention, the first drive beam and the second drive beam are advantageously of the same construction.

In one variant of the invention, the frame comprises a first upper beam for stabilizing the frame. The frame then also comprises a third connecting segment which connects the first upper beam to the first drive beam and a fourth connecting segment which connects the first upper beam to the second drive beam. This results, therefore, in a closed frame which in this case is formed from the two drive beams, the upper beam and the lower beam on the sides and the four connecting segments on the corners. Such a configuration is particularly stable relative to any type of torsion.

In particular, in this case the first connecting segment, the second connecting segment, the third connecting segment and the fourth connecting segment are of the same construction relative to one another. This simplifies the storage even further since only one type of connecting element has to be kept in stock.

The connecting segments are designed, in particular, as an integral component, i.e. in one piece. This significantly increases the stability relative to connecting segments which are made up of individual components. In this manner, a particularly lightweight and stable connecting segment may be achieved at the same time.

In a development of the invention, one or more, in particular all, components from the following list are produced at least partially from a fiber-reinforced plastics: the first drive beam, the second drive beam, the first upper beam, the first lower beam, the first connecting segment, the second connecting segment, the third connecting segment, the fourth connecting segment. This means that the first drive beam, the second drive beam, the first upper beam, the first lower beam, the first connecting segment, the second connecting segment, the third connecting segment and/or the fourth connecting segment are produced at least partially from a fiber-reinforced plastics.

If the frame comprises further upper beams or lower beams, as described below, these are preferably also produced at least partially from fiber-reinforced plastics.

The fiber-reinforced plastics may be carbon fiber plastics (CFP), glass fiber plastics (GFP) or aramid fiber plastics (AFP). Fiber-reinforced plastics comprising natural fibers are also possible. The plastics material is typically polyurethane, epoxy resin, polyester, vinylester or a hybrid resin. The plastics may additionally be mixed with additives such as flame retardants (for example based on aluminum trihydrate, aluminum oxihydrate or phosphorous), carbon nanotubes for improving the conductivity, core-shell particles for hardening or reactive diluents. This embodiment has the advantage that the frame is particularly lightweight and at the same time sufficiently stable to support the load of the elevator cabin even in extreme situations (for example emergency braking).

In a developed embodiment of the invention, the frame comprises a second lower beam. Moreover, the first connecting segment is of fork-shaped design and comprises a fork base and two fork ends. In this case the fork base is connected to the first drive beam and the two fork ends in each case are connected to the first and second lower beam. In this manner, an effective support of the cabin may be achieved by the load being evenly distributed to the two lower beams. Moreover, the number of production steps may still be kept low since the same first connecting segment is used for connecting the first lower beam to the first drive beam and the second lower beam to the first drive beam.

In a developed embodiment of the invention, the frame comprises a second upper beam. Moreover, the third connecting segment is of fork-shaped design and comprises a fork base and two fork ends. In this case the fork base is connected to the first drive beam and the two fork ends are in each case connected to the first and the second upper beam. In this manner, a stability which is improved even further may be achieved. Moreover, the number of production steps may still be kept low since the same third connecting segment is used for connecting the first upper beam to the first drive beam and the second upper beam to the first drive beam.

Naturally, the embodiment may be extended to more than two upper beams and lower beams by more than two fork ends being provided on the connecting segments.

Naturally, the number of upper beams does not necessarily have to be identical to the number of lower beams.

In a variant of the invention, the cross section of the first drive beam comprises a fastening portion with a tapering outer contour. At the same time, the cross section of the first connecting segment in a first connecting region to the first drive beam comprises a recess with a corresponding inner contour in order to receive positively the fastening portion of the first drive beam. The first drive beam and the first connecting segment may therefore be inserted into one another, wherein a positive connection is produced perpendicular to the insertion direction. The insertion direction in this case corresponds to a main direction of extent of the first drive beam. In this manner, a particularly efficient production process may be achieved. Moreover, the first drive beam and the first connecting segment lie against one another over a large surface, whereby the force transmission is distributed over a large contact surface. This ensures that temporary material overloads do not occur in the connecting region. In order to fix the first connecting segment in the insertion direction relative to the drive beam, fastening means which fix the first connecting segment to the drive beam are also arranged in the first connecting region of the first connecting segment. During the production process, therefore, the first drive beam and the first connecting segment merely have to be inserted into one another and fixed by means of the connecting means so that a relative movement in the insertion direction is also prevented. The connecting means may, in particular, be screw connections which prevent the relative movement by a positive connection.

In a development of the invention, the first lower beam has a rectangular cross section over its entire length. Within the meaning of this application, "rectangular" is also understood as a shape where the opposing edges thereof are substantially parallel to one another but the corners thereof are not sharp-edged but rounded. The cross section of the first connecting segment in a second connecting region to the first lower beam thus comprises a U-shaped recess with a corresponding inner contour in order to receive the first lower beam. The first lower beam may be mounted in a simple manner, therefore, by being inserted into the U-shaped recess in the second connecting region. The fixing may be carried out by any fastening means, such as for example screw connections.

In a development of the invention, the first drive beam comprises a U-shaped receiver, the first secondary part being arranged therein. The U-shaped receiver extends in this case over the entire length of the first drive beam. The first secondary part comprises, in particular, a first anchor plate with an adjacent first permanent magnet and a second anchor plate with an adjacent second permanent magnet. The first anchor plate extends in this case along a first limb of the U-shaped receiver and the second anchor plate extends along a second limb of the U-shaped receiver. This construction leads to an elongated gap along the first drive beam which is defined on both sides by the anchor plates with the adjacent permanent magnets. Therefore, the first primary part of the first linear motor which is arranged on the first rail extends inside this gap, so that the first secondary part of the first linear motor at least partially encloses the first primary part of the first linear motor.

In one specific embodiment, the first anchor plate comprises at least one connecting means which acts on the first drive beam in order to secure positively the first anchor plate against a movement in the direction of the second anchor plate. Accordingly, the second anchor plate also comprises at least one connecting means which acts on the first drive beam in order to secure positively the second anchor plate against a movement in the direction of the first anchor plate. In this manner, the two anchor plates with the adjacent permanent magnets are prevented from moving toward one another due to the magnetic forces and leaving their desired position. The connecting means may, for example, be one or more hook-shaped portions of the anchor plates which engage behind the first drive beam. This simplifies the mounting of the drive beam since the anchor plates with the adjacent permanent magnets only have to be inserted until the hook-shaped portions engage behind the drive beam and thus positively secure the anchor plates against the magnetic forces.

Additionally, a pole support may be arranged in the interior of the U-shaped receiver, said pole support holding the first anchor plate with the first permanent magnet and the second anchor plate with the second permanent magnet apart, counter to the magnetic forces. The pole support may be designed as a separate component or even as an integral component of the first drive beam.

In the above embodiments, for the sake of simplicity, in many cases only the first drive beam with its adjacent components and the first connecting segment have been described in detail. Therefore, it should be mentioned once again that the drive beams and the connecting segments, in particular, are of the same construction relative to one another, so that the above embodiments also refer to the further connecting segments and the second drive beam, as well as the connections thereof to one another. Similarly, the lower beams are preferably of the same construction relative to one another and also of the same construction relative to the upper beams.

Moreover, the first secondary part of the first linear motor and the second secondary part of the second linear motor, in particular, are of the same construction relative to one another and are arranged in an identical manner on the respective drive beam thereof. All of the embodiments which refer to the first secondary part of the first linear motor also accordingly apply to the second secondary part of the second linear motor.

All of the embodiments which refer to the connection of the lower beams to the connecting segments also accordingly apply to the connections of the upper beams to the connecting segments and vice-versa.

FIG. 1 shows an elevator system 11 according to the invention comprising a car 15 which is movable in an elevator shaft 13. In this case the car 15 comprises a frame 17 and a cabin 19. A first rail 21 and a second rail 23 are located on opposing sides of the elevator shaft 13. The car 15 is movable in the elevator shaft 13 along the two rails 21 and 23. The guidance of the car 15 in this case takes place via the rollers 16 which are connected to the frame and roll on the rails 21 and 23. The car 15 is driven by means of two linear motors 25 and 31. The first linear motor 25 comprises a first primary part 27 which is arranged on the first rail 21 and a first secondary part 29 which is arranged on the frame 17. Accordingly, the second linear motor 31 comprises a second primary part 33 which is arranged on the second rail 23 and a second secondary part 35 which is arranged on the frame 17.

The frame 17 itself is of modular construction and comprises a first drive beam 37, the first secondary part 29 being arranged thereon, and a second drive beam 39, the second secondary part 35 being arranged thereon. For supporting the cabin 19, the frame 17 comprises a first lower beam 41. Moreover, the frame 17 comprises a first connecting segment 43 which connects the first lower beam 41 to the first drive beam 37. The first connecting segment 43 is in this case placed onto the drive beam 37 and fixed by means of the fastening means 45. In detail, this fastening is described with reference to FIG. 4. The first lower beam 41 extends substantially perpendicular to the first drive beam 37. Opposite the first connecting segment 43, a second connecting segment 47 is arranged on the lower beam 41, said second connecting segment connecting the first lower beam 41 to the second drive beam 39. The second connecting segment 43 in this case is placed onto the second drive beam 39 and fixed by means of the fastening means 45.

Above the cabin 19 the frame 17 comprises a first upper beam 49 for stabilizing the frame 17. The first upper beam 49 is connected to the first drive beam 37 by means of a third connecting segment 51. Similarly, the first upper beam 49 is connected to the second drive beam 39 by means of a fourth connecting segment 53. The third connecting segment 51 and the fourth connecting segment 53 in this case are accordingly placed onto the first drive beam 37 and/or the second drive beam 39 and fixed by means of the fastening means 45.

The four connecting segments 43, 47, 51 and 53 in each case are designed to have the same construction. Similarly, the two drive beams 37 and 39 and the lower beam 41 and the upper beam 49 are of the same construction relative to one another. This modular construction consisting of only a few different components has the advantage that the size of the frame 17 may be adapted in a simple manner to the requirements of the respective elevator system. For example, the first lower beam 41 and the first upper beam 49 are designed as simple hollow profiles with a substantially rectangular cross section. For producing the frame 17 these hollow profiles are then stored in a standard size and cut to length according to the width of the required frame 17. Similarly, the drive beams 37 and 39 may also be stored in a standard size and then correspondingly cut to length, according to the specification of the height, during the production of the frame 17. From the connecting segments 43, 47, 51 and 53 which are arranged at the corners of the frame, depending on the size of the required frame 17 only one variant has to be stored during production. The same connecting segments may be used irrespective of the size of the required frame 17.

In the preferred variant shown, the first drive beam 37, the second drive beam 39, the first lower beam 41, the first upper beam 49 and all four connecting segments 43, 47, 51 and 53 are produced at least partially from fiber-reinforced plastics. In this case it may be carbon fiber plastics (CFP), glass fiber plastics (GFP) or aramid fiber plastics (AFP). Fiber-reinforced plastics comprising natural fibers are also possible. The plastics material is typically polyurethane, epoxy resin, polyester, vinylester or a hybrid resin. The plastics may additionally be mixed with additives such as flame retardants (for example based on aluminum trihydrate, aluminum oxyhydrate or phosphorous), carbon nanotubes for improving the conductivity, core-shell particles for hardening or reactive diluents. This embodiment has the advantage that the frame is particularly lightweight and at the same time sufficiently stable to bear the load of the cabin even in extreme situations (for example emergency braking).

Figure 2:
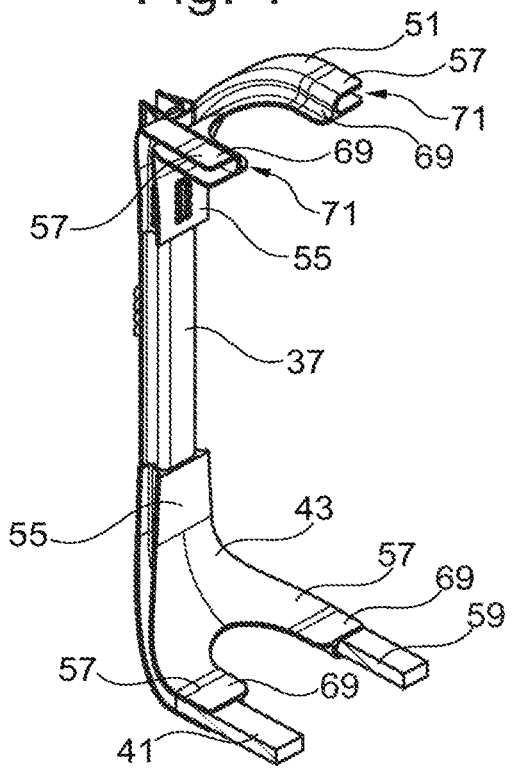
FIG. 2 is a perspective view of an example drive beam with connecting segments.

FIG. 2 shows a three-dimensional view of a first drive beam 37 with a first connecting segment 43 and a third connecting segment 51. Both connecting segments 43 and 51 are of fork-shaped design and have a fork base 55 and two fork ends 57. The fork base 55 of the first connecting segment is placed onto the drive beam 37. The two fork ends 57 of the first connecting segment are connected to a first lower beam 41 and a second lower beam 59. To this end, the two fork ends 57 of the first connecting segment 43 in a second connecting region 69 in each case have a U-shaped recess 71. In each case the first lower beam 41 and the second lower beam 59 are received in the U-shaped recess 71. The two lower beams 41 and 59 have over their entire length a rectangular cross section, the inner contour of the U-shaped recess 71 being adapted thereto. The third connecting segment 51 is of similar design, so that the fork base 55 of the third connecting segment 51 is connected to the drive beam 37 and the two fork ends 57 of the third connecting segment 51 in the second connecting region 69 in each case have a U-shaped recess 71 with an inner contour in order to receive a first upper beam and a second upper beam. For improved clarity, the two upper beams are not shown. The entire design of the upper beams, however, is identical to the lower beams 41 and 59 shown. The variant with two upper beams and two lower beams provides the entire frame with increased stability. Naturally, the design may be extended to more than two upper beams and lower beams, by more than two fork ends being provided on the connecting segments. Naturally, the number of upper beams does not necessarily have to be identical to the number of lower beams. Since the number of lower beams corresponds to the number of fork ends of the first and second connecting segments, in such a case only the first connecting segment 43 and the second connecting segment 47 which are connected to the lower beams would be of the same construction relative to one another. Accordingly, therefore, the third connecting segment 51 and the fourth connecting segment 53, the number of fork ends thereof corresponding to the number of upper beams, are of the same construction relative to one another.

Figure 3A:
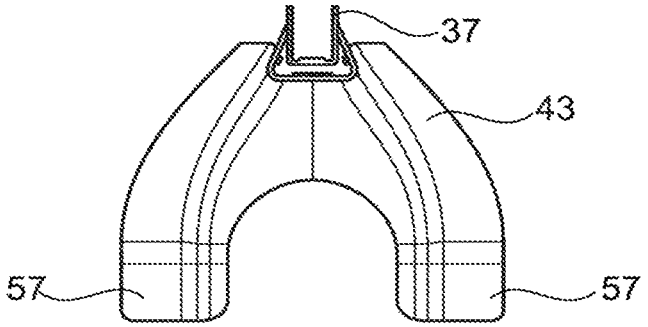
FIG. 3*a* is a side view of an example connecting segment.

FIG. 3*a* shows a first side view of a first connecting element 43 with two fork ends 57. The view in this case is in the main direction of extent of the first drive beam 37. From the view in FIG. 3*a*, it is clear that the drive beam 37 is inserted into the first connecting segment 43. The exact method of this fastening is described hereinafter with reference to FIG. 4.

Figure 3B:
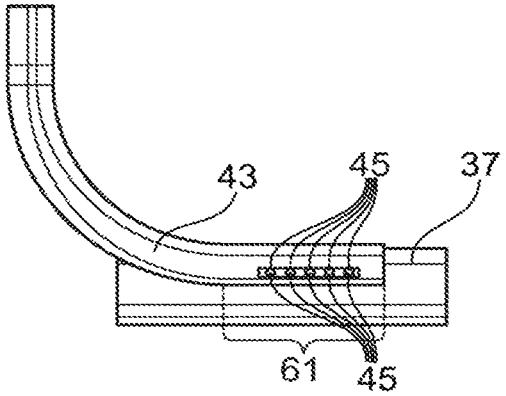
FIG. 3*b* is another side view of an example connecting segment.

FIG. 3*b* shows a second side view of a first connecting element 43 with the connected first drive beam 37. From the view it is clear that the first connecting segment 43 is connected to the first drive beam 37 in a first connecting region 61. A cutting line which indicates the position of the cross section shown in FIG. 4 is denoted by 63.

Figure 4:
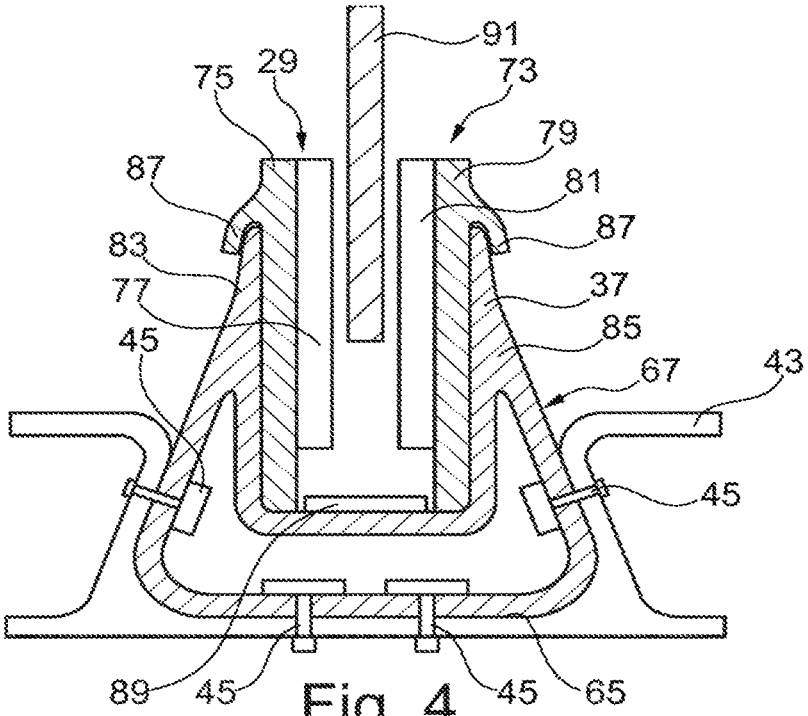
FIG. 4 is a sectional view through a first drive beam and a first connecting segment in a first connecting region.

FIG. 4 shows a section through the first drive beam 37 and the first connecting segment 43 in the first connecting region 61. The cross section of the first drive beam 37 comprises a fastening portion 65 with a tapering outer contour. Accordingly, the cross section of the first connecting segment 43 in the first connecting region to the first drive beam 37 shown comprises a recess 67 with a corresponding inner contour in order to receive positively the fastening portion 65 of the first drive beam 37. By this geometric design, the first drive beam 37 and the first connecting segment 43 may be inserted into one another, wherein a positive connection is produced perpendicular to the direction of insertion. In FIG. 4, the insertion direction extends perpendicular to the drawing plane. In order to fix the first connecting segment 43 to the first drive beam 37 additionally in the insertion direction, fastening means 45 are arranged in the connecting region 61 of the first connecting segment 43. Since the first drive beam 37 and the first connecting segment 43 are produced at least partially from fiber-reinforced plastics, the fastening means 45 are preferably designed in the form of screw connections with inserted threaded plates. In this manner, it is possible to ensure that a force is introduced over a large surface area.

On the side opposing the first connecting segment 43, the first drive beam 37 comprises a U-shaped receiver 73, the first secondary part 29 being arranged therein. The first secondary part 29 comprises a first anchor plate 75 with an adjacent first permanent magnet 77 and a second anchor plate 79 with an adjacent second permanent magnet 81. The first primary part 91 of the first linear motor 25 is arranged between the first permanent magnet 77 and the second permanent magnet 81. The first secondary part 29 of the first linear motor 25 thus encloses at least partially the first primary part 91 of the first linear motor 25. The first anchor plate 75 extends along a first limb 83 of the U-shaped receiver 73. The second anchor plate 79 extends along a second limb 85 of the U-shaped receiver 73. The first anchor plate 75 comprises a connecting means 87 which acts on the first drive beam 37 in order to secure positively the first anchor plate 75 against a movement in the direction of the second anchor plate 79. Accordingly, the second anchor plate 79 comprises a connecting means 87 which acts on the first drive beam 37 in order to secure positively the second anchor plate 79 against a movement in the direction of the first anchor plate 75. In the present case, the connecting means 87 are designed as hook-shaped portions which engage behind the drive beam and thus block a movement in the direction of the respective other anchor plate. A pole support 89 is arranged in the interior of the U-shaped receiver 73, said pole support holding the first anchor plate 75 with the first permanent magnet and the second anchor plate 79 with the second permanent magnet 81 apart, counter to the magnetic forces. The pole support 89 may be designed as a separate component, as in the view shown, or even as an integral component of the first drive beam 37.

In the previous embodiments, for the sake of simplicity, in many cases only the first drive beam with its adjacent components and the first connecting segment are described in detail. Therefore, it should be mentioned again that the drive beams and the connecting segments, in particular, are of the same construction relative to one another so that the above embodiments also refer to the further connecting segments and the second drive beam and the connections thereof to one another. Similarly, the lower beams are preferably of the same construction relative to one another and also the same construction relative to the upper beams.

Moreover, the first secondary part of the first linear motor and the second secondary part of the second linear motor, in particular, are of the same construction relative to one another and identically arranged on their respective drive beam. All of the embodiments which refer to the first secondary part of the first linear motor accordingly apply to the second secondary part of the second linear motor.

All of the embodiments which refer to the connection of the lower beams to the connecting segments accordingly apply to the connections of the upper beams to the connecting segments and vice-versa.

LIST OF REFERENCE NUMERALS

Elevator system 11
Elevator shaft 13

Car 15
Rollers 16
Frame 17
Cabin 19
First rail 21
Second rail 23
First linear motor 25
First primary part 27
First secondary part 29
Second linear motor 31
Second primary part 33
Second secondary part 35
First drive beam 37
Second drive beam 39
First lower beam 41
First connecting segment 43
Fastening means 45
Second connecting segment 47
First upper beam 49
Third connecting segment 51
Fourth connecting segment 53
Fork base 55
Fork ends 57
Second lower beam 59
First connecting region 61
Cutting line 63
Fastening portion 65
Recess 67
Second connecting region 69
Recess (U-shaped)
First anchor plate 75
First permanent magnet 77
Second anchor plate 79
Second permanent magnet 81
First limb 83
Second limb 85
Connecting means 87
Pole support 89
First primary part 91

What is claimed is:

1. An elevator system, comprising:

a car that is movable in an elevator shaft having a first rail, wherein the car comprises a frame and a cabin, with the frame including:

a first drive beam, a first lower beam for supporting the cabin, a second lower beam, and a first connecting segment that connects the first lower beam to the first drive beam, wherein the first connecting segment is fork-shaped and comprises a fork base and two fork ends, wherein the fork base is connected to the first drive beam and the two fork ends are connected to the first and second lower beams; and a first linear motor with a first primary part and a first secondary part, wherein the first primary part is disposed on the first rail, wherein the first secondary part is disposed on the first drive beam of the frame and at least partially encloses the first primary part.

2. The elevator system of claim 1 wherein a second rail is disposed in the elevator shaft, the elevator system comprising a second linear motor with a second primary part and a second secondary part, wherein the second primary part is disposed on the second rail, wherein the frame comprises a second drive beam on which the second secondary part is disposed, wherein the frame comprises a second connecting segment that connects the first lower beam to the second drive beam.

3. The elevator system of claim 2 wherein the frame comprises:

a first upper beam for stabilizing the frame;

a third connecting segment that connects the first upper beam to the first drive beam; and a fourth connecting segment that connects the first upper beam to the second drive beam.

4. The elevator system of claim 3 wherein the first, second, third, and fourth connecting segments have the same construction.

5. The elevator system of claim 3 wherein at least one of the first drive beam, the second drive beam, the first upper beam, the first lower beam, the first connecting segment, the second connecting segment, the third connecting segment, or the fourth connecting segment comprises fiber-reinforced plastic.

6. The elevator system of claim 1 wherein a cross section of the first drive beam comprises a fastening portion with a tapering outer contour, wherein a cross section of the first connecting segment in a first connecting region to the first drive beam comprises a recess with a corresponding inner contour for positively receiving the fastening portion of the first drive beam.

7. The elevator system of claim 6 comprising fastening means for fixing the first connecting segment to the first drive beam, the fastening means being disposed in the first connecting region of the first connecting segment.

8. The elevator system of claim 6 wherein the first lower beam has a rectangular cross section over a complete length of the first lower beam, wherein a cross section of the first connecting segment in a second connecting region to the first lower beam comprises a U-shaped recess with a corresponding inner contour to receive the first lower beam.

9. The elevator system of claim 1 wherein the first drive beam comprises a U-shaped receiver on which the first secondary part is disposed.

10. The elevator system of claim 9 wherein the first secondary part comprises a first anchor plate with an adjacent first permanent magnet and a second anchor plate with an adjacent second permanent magnet, wherein the first anchor plate extends along a first limb of the U-shaped receiver and the second anchor plate extends along a second limb of the U-shaped receiver.

11. The elevator system of claim 10 comprising a pole support disposed in an interior of the U-shaped receiver, the pole support holding the first anchor plate with the first permanent magnet apart from the second anchor plate with the second permanent magnet, counter to magnetic forces.

12. The elevator system of claim 10 wherein the first anchor plate comprises connecting means that acts on the first drive beam to positively secure the first anchor plate against a movement in a direction of the second anchor plate.

13. The elevator system of claim 12 wherein the second anchor plate comprises connecting means that acts on the first drive beam to positively secure the second anchor plate against a movement in a direction of the first anchor plate.

14. An elevator system, comprising:

a car that is movable in an elevator shaft having a first rail, wherein the car comprises a frame and a cabin, with the frame including:

a first drive beam, a first upper beam for stabilizing the frame, a second upper beam, a third connecting segment that connects the first upper beam and the second upper beam to the first drive beam, wherein the third connecting segment is fork-shaped and comprises a fork base and two fork ends, wherein the fork base is connected to the first drive beam and the two fork ends are connected to the first and second upper beams; and a first linear motor with a first primary part and a first secondary part, wherein the first primary part is disposed on the first rail, wherein the first secondary part is disposed on the first drive beam of the frame and at least partially encloses the first primary part.

15. The elevator system of claim 14, wherein a second rail is disposed in the elevator shaft, the elevator system comprising a second linear motor with a second primary part and a second secondary part, wherein the second primary part is disposed on the second rail, wherein the frame comprises a second drive beam on which the second secondary part is disposed, wherein the frame comprises a fourth connecting segment that connects the first upper beam to the second drive beam.

16. The elevator system of claim 14, wherein a cross section of the first drive beam comprises a fastening portion with a tapering outer contour, wherein a cross section of the third connecting segment in a first connecting region to the first drive beam comprises a recess with a corresponding inner contour for positively receiving the fastening portion of the first drive beam.

17. The elevator system of claim 16, further comprising fastening means for fixing the third connecting segment to the first drive beam, the fastening means being disposed in the first connecting region of the third connecting segment.

18. The elevator system of claim 16, wherein the first upper beam has a rectangular cross section over a complete length of the first upper beam, wherein a cross section of the third connecting segment in a second connecting region to the first upper beam comprises a U-shaped recess with a corresponding inner contour to receive the first upper beam.

19. The elevator system of claim 14, wherein the first drive beam comprises a U-shaped receiver on which the first secondary part is disposed.

20. The elevator system of claim 19, wherein the first secondary part comprises a first anchor plate with an adjacent first permanent magnet and a second anchor plate with an adjacent second permanent magnet, wherein the first anchor plate extends along a first limb of the U-shaped receiver and the second anchor plate extends along a second limb of the U-shaped receiver.

21. The elevator system of claim 20, further comprising a pole support disposed in an interior of the U-shaped receiver, the pole support holding the first anchor plate with the first permanent magnet apart from the second anchor plate with the second permanent magnet, counter to magnetic forces, wherein the first anchor plate comprises connecting means that acts on the first drive beam to positively secure the first anchor plate against a movement in a direction of the second anchor plate, wherein the second anchor plate comprises connecting means that acts on the first drive beam to positively secure the second anchor plate against a movement in a direction of the first anchor plate.

* * * * *